United States Patent [19]

Lautenschläger et al.

[11] Patent Number: 5,008,977

[45] **Date of Patent: * Apr. 23, 1991**

[54] CABINET HINGE WITH CLOSING MECHANISM

[75] Inventors: Karl Lautenschläger, Reinheim; Gerhard W. Lautenschläger, Brensbach, both of Fed. Rep. of Germany

[73] Assignee: Karl Lautenschläger GmbH & Co. KG, Reinheim, Fed. Rep. of Germany

[ * ] Notice: The portion of the term of this patent subsequent to Jan. 23, 2007 has been disclaimed.

[21] Appl. No.: 504,345

[22] Filed: Apr. 4, 1990

[30] Foreign Application Priority Data

Apr. 18, 1989 [DE] Fed. Rep. of Germany ..... 3912630

[51] Int. Cl.[5] ..... E05F 1/08

[52] U.S. Cl. ..... 16/278; 16/288; 16/291

[58] Field of Search ..... 16/278, 288, 291, 294, 16/296

[56] References Cited

U.S. PATENT DOCUMENTS

| | | | |
|---|---|---|---|
| 4,373,230 | 2/1983 | Lautenschläger | 16/288 |
| 4,457,047 | 7/1984 | Lautenschläger | 16/291 |
| 4,596,062 | 6/1986 | Rock | 16/288 |
| 4,654,930 | 4/1987 | Lautenschläger | 16/288 |
| 4,894,884 | 1/1990 | Lautenschläger | 16/278 |

FOREIGN PATENT DOCUMENTS

| | | | |
|---|---|---|---|
| 2401178 | 7/1975 | Fed. Rep. of Germany | 16/288 |
| 2920156 | 11/1979 | Fed. Rep. of Germany | 16/288 |
| 159895 | 4/1983 | German Democratic Rep. | 16/277 |
| 2041067 | 9/1980 | United Kingdom | 16/278 |

*Primary Examiner*—Richard K. Seidel
*Assistant Examiner*—Chuck Y. Mah

[57] ABSTRACT

Cabinet hinge having a door-related part configured as a plug-in cup and a carcass-related part configured as an elongated supporting arm, which are articulated relative to one another by two hinge links journaled at their ends in the cup at one end and on the supporting arm at the other. The hinge has a closing mechanism having a cam element disposed at the inner end of the inner hinge link, which is joined corotationally with the hinge link, and on whose cam surface a resiliently flexible section of one leg of a substantially U-shaped leaf spring lies under bias while its second leg is joined to the outer end of the resiliently flexible leg in the interior of the supporting arm by a bridging section and thrusts against the interior of the supporting arm. The inner hinge link has at its inner end two parallel ears spaced apart from one another, between which the cam element is disposed for corotation therewith.

9 Claims, 2 Drawing Sheets

CABINET HINGE WITH CLOSING MECHANISM

BACKGROUND OF THE INVENTION

The invention relates to a hinge for cabinet doors, with a door-related hinge part in the form of a cup which can be set in a mortise in the back of a door, and a carcass-related part in the form of an elongated supporting arm of an inverted U-shaped cross section. These parts are articulated together by two hinge links journaled at their extremities in the cup at their one end and on the supporting arm at their other end. Such a hinge also has a closing mechanism wherein a cam element is disposed in the sup- porting-arm end portion of the inner hinge link nearer the cabinet interior when the door is closed and is joined for corotation with the hinge link. On the cam surface of the cam element a resiliently flexible section of one leg of a substantially U-shaped leaf spring lies under bias while its second leg is joined by a bridging section to the end remote from the cup of the resiliently flexible leg and is supported in the supporting arm interior.

Such hinges have proven practical (German Federal Patent 24 08 057) and have been used for many years in great numbers for hanging doors on cabinets. The cam element in these known hinges is formed by two plastic cams fitted onto the opposite lateral margins of the carcass end of the inner hinge link provided with a rolled pivot eye. The resiliently flexible leg of the leaf spring which cooperates with the track of the cam element must on the one hand contact the cam with a certain bias, and on the other hand it must also be sufficiently strong to produce the desired closing characteristic. Consequently the leg and thus also the leaf spring must have a certain total length. This requires, however, that sufficient space be available in the interior of the supporting arm for the installation of the leaf spring. The known closing mechanism therefore is not easily applicable to hinges in which this space is restricted, because for example the adjusting screw serving to vary the overlap of the door on the front edge of the lateral wall of the cabinet carcass is provided in the front end portion of the supporting arm in order to keep the supporting arm particularly short overall. The case becomes especially critical when such a supporting arm is greatly offset, i.e., its front end toward the cup is at a relatively great distance from the inside surface of the corresponding carcass wall, since the said adjusting screw then has to be disposed in a trough-like indentation in the web of the supporting arm. The link end of this trough-like indentation then additionally diminishes the space available for the spring, to such an extent that the known closing mechanism can no longer be used.

It is the object of the invention, therefore, to improve the known hinge such that even in a case in which the space for the arrangement of the leaf spring in the supporting arm interior is limited, the hinge can be provided with a closing mechanism that will be just as functional and will be comparable as regards its manner of operation and its reliability.

THE INVENTION

Setting out from a hinge of the kind described above, this object is achieved in accordance with the invention in that the inner hinge link has at its end journaled in the supporting arm two parallel ears spaced apart from one another, between which the cam element is disposed for corotation. It is thus possible to shape the inner hinge link such that the cam element disposed between its ears is rotatable more toward the door end of the supporting arm, so that the leaf spring also can be shifted further by a corresponding amount toward the front end of the supporting arm.

In a preferred further development of the invention, the cam element is a plastic body filling the space between the ears of the inner hinge link, and the pivot pin, which is held in the lateral flanges of the supporting arm, passes through the pivot bores in the ears and holds the supporting-arm end of the inner hinge links, passes through a bore which is provided in the plastic body, and is aligned with the pivot bores in the ears. Then, to hold the plastic body between the ears for corotation with them, it is recommended to provide a second bore in the plastic body at a distance from the bore through which the pivot pin passes, and to put a pin through it and through bores aligned with it in the ears of the inner hinge link and rivet its ends to the ears.

The first resilient leg of the leaf spring then will have, in its area cooperating with the track of the cam element, a width corresponding approximately to the clearance between the ears or a slightly lesser width, while the remainder of this leg, its adjoining loop and the second leg of the leaf spring can have a width corresponding approximately to the inside distance between the flanges of the supporting arm or a slightly lesser width.

The inner hinge link is best configured as an elongated part stamped from sheet steel on whose cup-adjacent end the pivot eye is rolled for the pivot in the cup, while the ears are formed by tabs cut from the opposite margins of the other end and bent 90° from the plane of the link itself.

In regard to how far it can reach in the direction of the ears, the cam body is best made slightly shorter than the ears themselves in the area lying between the ears, the cam surface of the cam body being then formed on the area of the plastic body facing the end portion of the link where the ears are joined together, but it is situated at a distance away from this end portion. The leg of the leaf spring that cooperates with the cam surface of the cam element then will fit into the gap between the above-mentioned end portion of the link and the cam surface of the cam element situated at a distance opposite the said end portion.

The stability of the journaling of the inner hinge link on the associated pivot can be improved by a configuration in which the ears have on their inner surfaces facing the cam element, in the area of the pivot bores, an annular projection making the length of the pivot bores greater than the thickness of the particular ear, these annular projections engaging matingly in complementary annular indentations in the cam element. The prolongation of the pivot bores results in a corresponding reduction of the stress and thus an improvement of the useful life.

The pivot bores provided in the ears and the bore aligned therewith in the cam element have preferably equal diameters, namely the outside diameter of the pivot, so that a portion of the bearing forces will be applied through the bore in the cam element, and accordingly the pivot bores in the ears will be further relieved of stress.

To be able to mount the cam element in the space between the ears, the cam element is provided, in a desirable further development of the invention, with a continuous, slot-like opening running parallel to the ears in its lower area through which the pivot passes. This opening permits a limited resilient flexure of the cam element in this lower area, so that the annular indentations provided in the pivot bore area can be snapped over the annular projections of the ears with a resilient compression of the cam element.

BRIEF DESCRIPTION OF THE DRAWINGS

The invention is further explained in the following description of an embodiment, in conjunction with the drawing, wherein.

Figure 1:
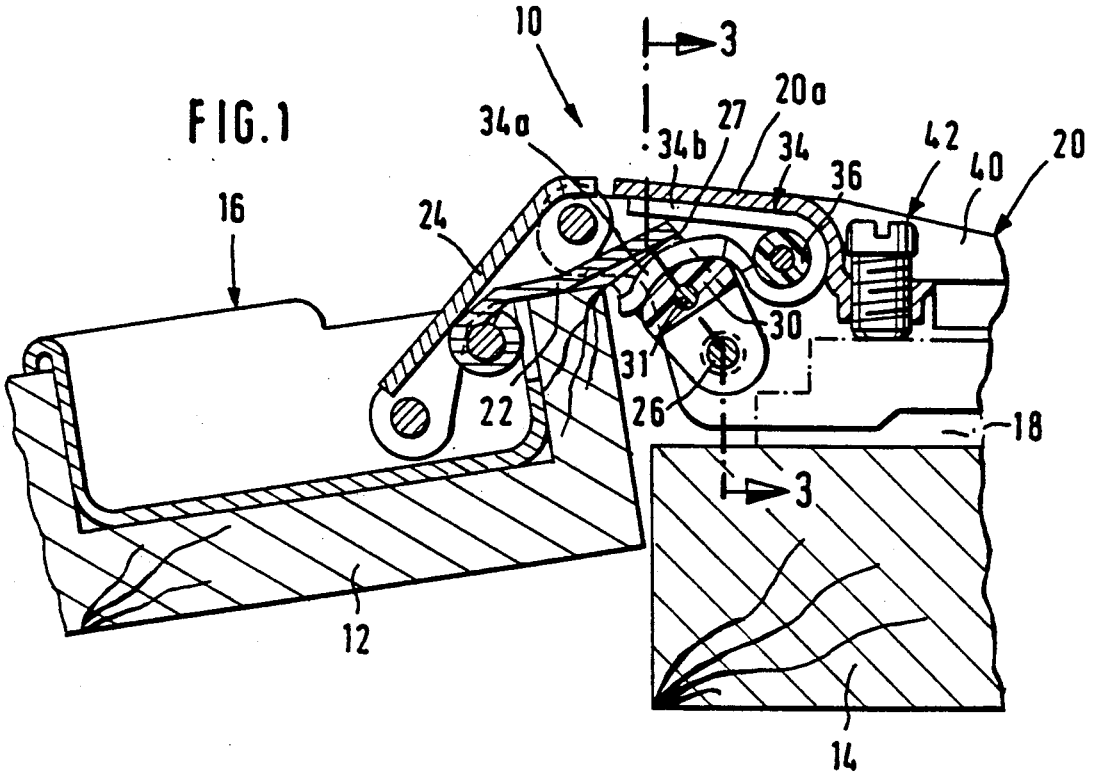
FIGS. 1 and 2 are longitudinal central sections through the cup end of the supporting arm and the cup of a hinge in accordance with the invention, as well as of the corresponding areas of the carcass wall and door with the hinge in the open and closed position, respectively.
Figure 2:
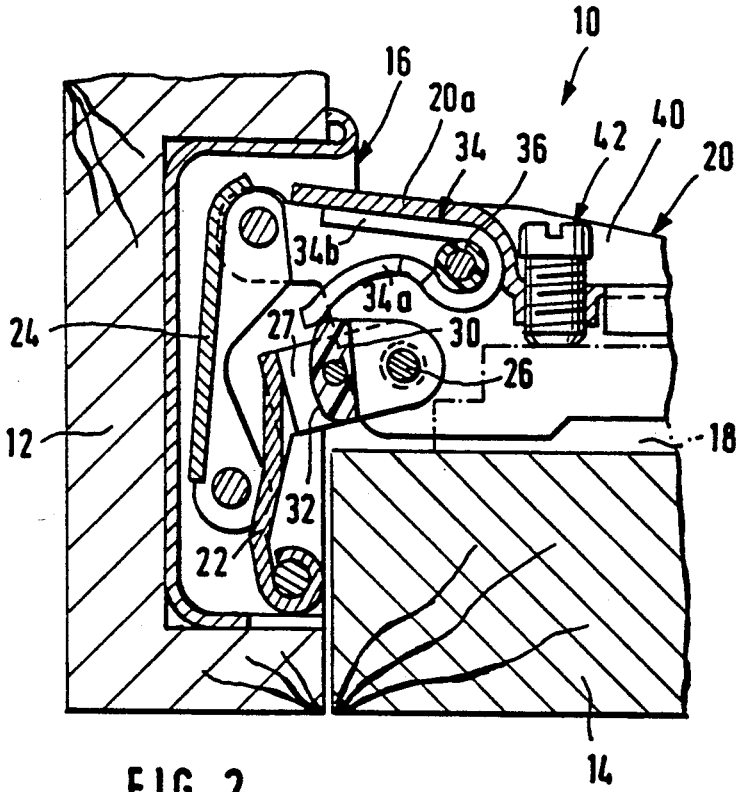
Figure 3:
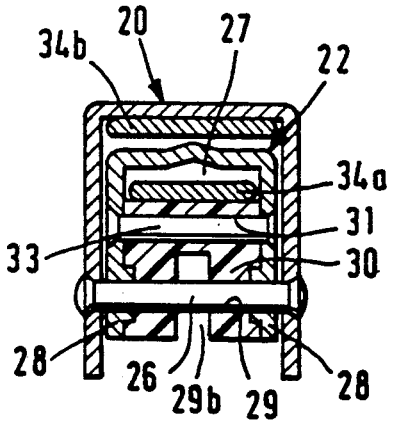
FIG. 3 is a sectional view taken along line 3—3 in FIG. 1.

The hinge shown in FIGS. 1 and 2 and identified in its entirety by the number 10 serves for hanging a door 12 on the wall 14 of a cabinet carcase otherwise not represented. The hinge 10 consists in a known manner of a door-related hinge part in the form of a cup 16 which can be set in a mortise in the back of the door 12. The part of the hinge that is to be attached to the carcase is an elongated arm 20 of U-shaped cross section, which is adjustably mounted on a mounting plate 18 affixed to the carcass wall 14. The door-related part of the hinge is coupled with the carcass wall-related part by two links 22, 24, pivoted at their ends in the cup 16 and in the supporting arm 20, respectively.

A closing mechanism, or over-center mechanism, provided in the front end of the supporting arm adjacent the cup has a cam element 30 with a cam surface 32 in the vicinity of the carcass-wall end of the inner link 22, i.e., the link situated nearer the cabinet interior when the door is closed, which is articulated on a pivot pin 26 held fixedly in the supporting arm. The cam element 30, which is a plastic body, is disposed largely between two elongated ears 28 bent at right angles from the lateral margins of the inner hinge link 22, in the end portion within the supporting arm, the cam surface 32 facing generally toward the end portion adjoining the ears of the hinge link 22, but a gap 27 remains between the cam surface 32 and this end portion of the hinge link. The corotational holding of the cam element 30 between the ears 28 is brought about on the one hand by passing the pivot pin 26 through a bore 29 in cam body 30 that is in alignment with the pivot bores **28*a* in the ears 28, and furthermore an additional bore 31 in the cam element 30 at a distance from the bore 29 holds a pin 33 fixed, by riveting for example, in the ears 28**.

One leg **34*a* of a U-shaped leaf spring is resiliently flexible at right angles to the hinge articulation axis, and is biased against the cam surface 32; its other leg 34*b* thrusts against the bottom of the web of the supporting arm 20. The leaf spring 34 is retained in the position represented, with its ends pointing out of the interior of the carcass, by a pin which is held between the lateral flanges of the supporting arm 20 and bears a bolster 36 for adaptation to the transitional arch between the legs 34*a*, 34*b*, of the spring. The transitional arch or bridge section between the legs 34*a*, 34*b*, of the leaf spring 34 is wrapped around the sleeve 36** over an angle of more than 180°.

In FIGS. 1 and 2 it can also be seen that the supporting arm 20 in the embodiment represented is provided with an adjusting screw 42 in a trough-like indentation 40 in its web **20*a* to enable the overlap of the (closed) door 12 on the front edge of the carcase wall 14 to be varied. Since, in comparison with other hinges, this adjusting screw is set relatively far forward, i.e., toward the outside end of the supporting arm pointing out of the carcass there is not much space available for disposing the leaf spring 34 inside of the supporting arm in front of the wall of the indentation 40 in the supporting arm interior which defines the front end of the trough-like indentation and holds the leaf spring 40 on the bolster 36. By disposing the cam element 30 between the ears 28 and the gap 27 formed between the cam surface 32 of the cam element 30 and the hinge link 22, the leg 34*a*, despite the small amount of space available, can be made long enough since the leg 34 can extend all the way into this gap 27**.

Figure 4:
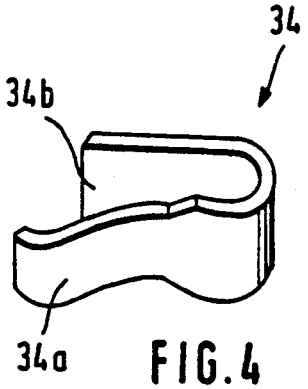
FIG. 4 is a perspective representation of the leaf spring of the closing mechanism of the hinge represented in FIGS. 1 and 2.

In FIG. 4 it can also be seen that the leg **34*a* of leaf spring 34 has for this purpose a reduced width in the portion cooperating with the cam surface 32, so that, when the door 12 is opened (FIG. 1) it can enter the gap 27 laterally defined by the ears 28** without interfering with these ears.

The shape of the cam surface 32 and the manner in which it cooperates with the free end of leg **34*a* of the leaf spring otherwise correspond to the known hinge, so that the same operating characteristic can be achieved even though the leaf spring 34** as a whole is located further out toward the outer end of the supporting arm.

Figure 5:
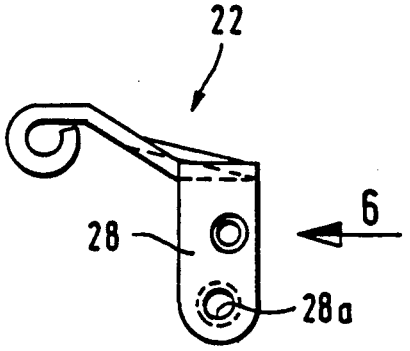
FIG. 5 is a side view of the inner hinge link of the hinge shown in FIGS. 1 and 2.
Figure 6:
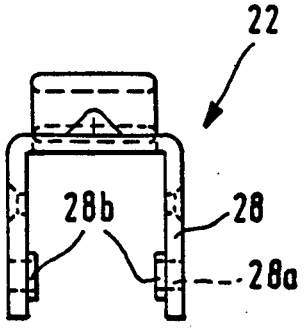
FIG. 6 is a view of the inner hinge link, seen in the direction of the arrow 6 in FIG. 5.

In FIGS. 5 and 6 showing the inner hinge link 22 as a single part, it can be seen that the pivot bores **28*a* are continued in annular projections 28*b* extending from the confronting inside surfaces of the links 28, thereby increasing the bearing area on the pivot pin 26** and accordingly reducing the bearing stress.

Figure 7:
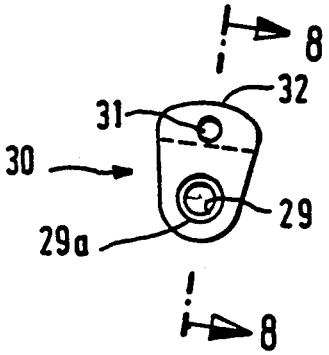
FIG. 7 is a side view of the cam element of the hinge shown in FIGS. 1 and 2.
Figure 8:
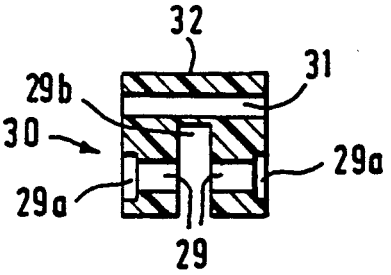
FIG. 8 is a section through the cam element, seen in the direction of the arrows 8—8 in FIG. 7.

With the annular projections **28*b* there are associated as it can be seen in FIGS. 7 and 8 complementary annular recesses 29*a* in the cam element 30. The annular projections 28*b* will therefore be matingly engaged in the annular recesses 29*a* when the cam element 30** is properly installed.

So that the installation of the cam element, whose width is the same as the clearance between the ears 28, may be possible in spite of the annular projections **28*b*, a central slot 29*b* is provided running parallel to the ears 28, as it can be seen especially in FIG. 8. This slot permits the cam element 30 to be resiliently compressed in the area of its bore 29 to such an extent that the recesses 29*a* can be snapped over the annular projections 28*b***.

The bore 29 in cam 30 can best have the same diameter as the pivot bore **28*a* in the ears 28, i.e., equal to the outside diameter of the pivot pin 26, so that the bore 29 of the cam element 30 absorbs a part of the bearing stresses and accordingly relieves the stress on the pivot bores 28*a*** in the ears.

We claim:

1. A hinge for a cabinet door, comprising: a door-related part configured as a cup to be set in the back of a cabinet door, and a carcass-related part configured as an elongated supporting arm of inverted U-shaped cross section and to be mounted on a cabinet; an inner and an outer hinge link articulating said two parts relative to one another, each link having a first end journaled in the cup and a second end journaled at the supporting arm, said inner hinge link being nearer the cabinet interior when the door has been articulated to the closed position; a closing mechanism having a cam element disposed in an end portion of said inner link adjacent said supporting arm, said cam element having a cam surface; a substantially U-shaped leaf spring having a first, flexible leg lying with bias on said cam surface, having a second leg supported in an interior portion of said supporting arm, and also having a bridging section connecting said two legs; said inner hinge link having two parallel ears spaced apart from one another at said second end of said inner hinge link; said cam element being disposed between said ears for corotation with said inner hinge link.

2. A hinge according to claim 1, wherein said cam element is a body of plastic material filling the space between said spaced apart ears, a first bore in said body, pivot bores in said ears, and a pivot pin journalling the second end of said inner hinge link at said supporting arm being fixed in spaced lateral flanges of said supporting arm and passing through said first bore and said pivot bores.

3. A hinge according to claim 2, comprising a second bore in the body at a distance from said first bore, a pin passing through said second bore and through aligned bores in the ears, said last-mentioned pin having ends riveted to the ears.

4. A hinge according to claim 2 or 3, wherein said first resilient leg of the leaf spring has in an area thereof cooperating with the cam surface a width corresponding approximately to the clearance between the ears, the remaining part of said first leg, of the bridging section, and of the second leg of the leaf spring having a width corresponding approximately to the clearance between the spaced flanges of the supporting arm or a slightly lesser width.

5. A hinge according to claim 1, wherein the inner hinge link is an elongated sheet steel stamping having an end adjacent the cup which is rolled to form a pivot eye for journalling in the cup, the ears being formed by tabs cut on opposite margins of the other end of the stamping and bent 90 degrees from the plane of the inner hinge link.

6. A hinge according to claim 2, wherein the body has a slightly shorter length between the ears than the ears, the cam surface being formed by the surface of the body facing the end portion of the inner link joining the ears and confronting said end portion at a distance away from the same.

7. A hinge according to claim 2, wherein the ears have inside surfaces facing the cam element and on said inside surfaces in the area of each of the pivot bores, an annular projection increasing the length of the pivot bores beyond the thickness of the respective ear, the annular projections engaging matingly in complementary annular recesses in the cam element.

8. A hinge according to claim 7, wherein the pivot bores in the ears and the first bore in the cam element have the same diameter and align with one another.

9. A hinge according to claim 7 or 8, wherein the cam element has a lower portion through which the pivot pin passes, and a through-going, slot-like opening in said lower portion and running parallel to the ears.

* * * * *